US005983056A

United States Patent [19]

Fukami et al.

[11] Patent Number: 5,983,056

[45] Date of Patent: Nov. 9, 1999

[54] PHOTOSENSITIVE DRUM AND IMAGE PROCESSING UNIT

[75] Inventors: Toshiyuki Fukami; Tetsuro Tomoe; Yoshifumi Okauchi; Yuji Tanaka; Tohru Ueno; Hiroshi Mishima, all of Osaka, Japan

[73] Assignee: Mita Industrial Co., Ltd., Osaka-fu, Japan

[21] Appl. No.: 09/031,856

[22] Filed: Feb. 27, 1998

[30] Foreign Application Priority Data

Mar. 14, 1997 [JP] Japan ..... 9-061415

[51] Int. Cl.[6] ..... G03G 15/00

[52] U.S. Cl. ..... 399/167

[58] Field of Search ..... 399/157, 158, 399/160, 111, 116, 167, 159

[56] References Cited

FOREIGN PATENT DOCUMENTS 574959 12/1993 European Pat. Off. .
622698 11/1994 European Pat. Off. .
4239459 5/1993 Germany .

*Primary Examiner*—William Royer
*Assistant Examiner*—Greg Moldafsky
*Attorney, Agent, or Firm*—Jordan and Hamburg LLP

[57] ABSTRACT

This invention relates to an image forming apparatus in which a cleaning device is arranged above a photosensitive drum close thereto. The image forming apparatus has an image processing unit provided with the photosensitive drum. The photosensitive drum is constructed such that a gear portion formed in a flange member at one axial end of the photosensitive drum has a diameter not greater than an outer diameter of the photosensitive drum. The image processing unit is constructed such that a driving force from the image forming apparatus is transmitted to the photosensitive drum via the gear portion formed in the one flange member to rotate the photosensitive drum and is transmitted to at least one of image processor means via a gear portion formed in a flange member at the opposite axial end of the photosensitive drum. With this arrangement, a poor image formation due to a blocking phenomenon resulting from long stay of toner residues can be prevented and downsizing of the image forming apparatus is realized.

11 Claims, 5 Drawing Sheets

PHOTOSENSITIVE DRUM AND IMAGE PROCESSING UNIT

BACKGROUND OF THE INVENTION

1. Field of the Invention

This invention relates to a photosensitive drum and an image processing unit for use in an image forming apparatus such as a copier, a printer, or a facsimile machine.

2. Description of the Background Art

An image forming apparatus including an image forming unit with a photosensitive drum is known. The image forming apparatus is operated in such a manner that an electrostatic latent image obtained from an image on an original document is formed on a surface of the photosensitive drum, developed into a toner image by attracting toner onto the latent image, and the toner image is transferred onto a copy sheet and fixed thereon. After the image forming operation, toner residues on the surface of the photosensitive drum are removed by a mechanical means or by utilizing static electricity.

Generally, a cleaning device which removes toner residues by the mechanical means is operated such that a cleaning blade is provided in pressing contact with the surface of the drum surface. Toner residues are scraped out from the drum surface by a frictional force generated between the drum surface and the blade in contact therewith, and the scraped out toner residues are collected by one of the following ways: 1) the toner residues are directly collected in a toner collecting container provided in the cleaning device; 2) carried into a toner collecting container by a rotational force of a screw shaft provided in a cleaning device; or 3) directly returned to a developing unit for reuse (recycling operation).

FIG. 6 shows an image forming apparatus provided with an image processing unit of the prior art. Referring to FIG. 6, a cleaning device 40 is provided above a photosensitive drum 41. In this arrangement, a cleaning blade 40*a* and a lower edge 40*c* of a casing member 40*b* which integrally and unitarily constitutes the cleaning device 40 come into contact with an upper circumferential surface of the photosensitive drum 41 in parallel to each other.

Toner residues scraped out by the cleaning blade 40*a* are required to be promptly carried into a toner collecting container (not shown) disposed away from the photosensitive drum 41.

More specifically, toner residues scraped out from the drum surface are collected in a chamber 40*d* defined by the cleaning blade 40*a* and the casing member 40*b* of the cleaning device 40. The toner residues collected in the chamber 40*d* are carried away into the toner collecting container by rotating a screw shaft 40*e* provided in the cleaning device 40. The screw shaft 40*e* is longer than an axial length of the photosensitive drum 41.

Referring to FIG. 6, this image forming apparatus comprises a developing unit 42, a transfer roller 43, a blank lamp (light source for removing remaining charges on the drum surface) 44, a main charger 45, a fixing unit 46, and an optical unit 47. A copy sheet P which is dispensed out of a paper cassette 48 is discharged onto a stacker tray 49 after an image is formed on the copy sheet P while being transported along the direction of arrow B.

In this image forming apparatus, the screw shaft 40*e* is rotated by driving a pinion gear provided at one axial end of the screw shaft 40*e* and a gear portion formed in a flange member at one end of the photosensitive drum 41 in the axial direction which is in mesh with the screw shaft pinion gear. In such an arrangement, there is a tendency that a large amount of toner residues remains in the chamber 40*d* because the outer circumference of screw shaft 40*e* is provided away from the outer circumference of the photosensitive drum 41, i.e., is not provided sufficiently close to the outer circumference of photosensitive drum 41. If such large amount of toner residues remains in the chamber 40*d*, toner discharge out of the chamber 40*d* is not performed properly due to a "blocking phenomenon" (toner discharge is blocked by the toner residues which have already heaped up in a compressed state and clogged in the chamber 40*d*). Consequently, a poor image formation results from the blocking phenomenon.

Further, other image processor means (peripheral devices) such as the developing device and the main charger which are arranged in the periphery of the photosensitive drum cannot be disposed close to the photosensitive drum as well as the cleaning device because of the large gear portion formed in the flange member at the axial end of the photosensitive drum. Thereby, there cannot be avoided production of a large-scaled image processing unit or an image forming apparatus as a whole.

SUMMARY OF THE INVENTION

In view of the above drawbacks of the prior art, it is an object of this invention to provide a photosensitive drum and an image processing unit in which a cleaning device is arranged above the photosensitive drum close that can eliminate a blocking phenomenon of toner residues leading to a poor image formation, while downsizing an image forming apparatus.

To accomplish the above objects, the photosensitive drum according to this invention comprises a cylindrical main body; a flange member mounted at opposite ends in an axial direction of the main body; and a gear formed on at least one of the flange members, having an outer diameter smaller than an outer diameter of the photosensitive drum main body.

The above and other objects, features and advantages of the present invention will become more apparent upon a reading of the following detailed description and drawings.

DETAILED DESCRIPTION OF THE PREFERRED EMBODIMENTS OF THE INVENTION

A photosensitive drum according to this invention is constructed in such a manner that at least one of flange members mounted at opposite ends of the photosensitive drum in an axial direction thereof is formed with a gear portion having an outer diameter thereof not greater than an outer diameter of a main body of the photosensitive drum. Accordingly, in the case where a cleaning device is arranged above the photosensitive drum, and a screw shaft with a length thereof greater than the axial length of the photosensitive drum is disposed in parallel with the photosensitive drum in the axial direction thereof in such a manner that a gear portion formed at the other flange member of the photosensitive drum is in mesh with a pinion gear of the screw shaft, the screw shaft can be disposed close to the photosensitive drum with a sufficiently small clearance therebetween.

When the photosensitive drum having the above arrangement is adapted in an image forming apparatus, a member of an image processing unit which is disposed in the periphery of the photosensitive drum, e.g., a screw shaft constituting a cleaning mechanism (cleaning device) can be arranged sufficiently close to the photosensitive drum to enable downsizing of the apparatus.

According to this invention, an image processor such as the cleaning device which is arranged in the periphery of the photosensitive drum and constitutes the image processing unit can be assembled in a small space, thereby downsizing the image processing unit as a whole.

Hereinafter, a preferred embodiment of this invention is described with reference to the accompanying drawings.

Figure 1:
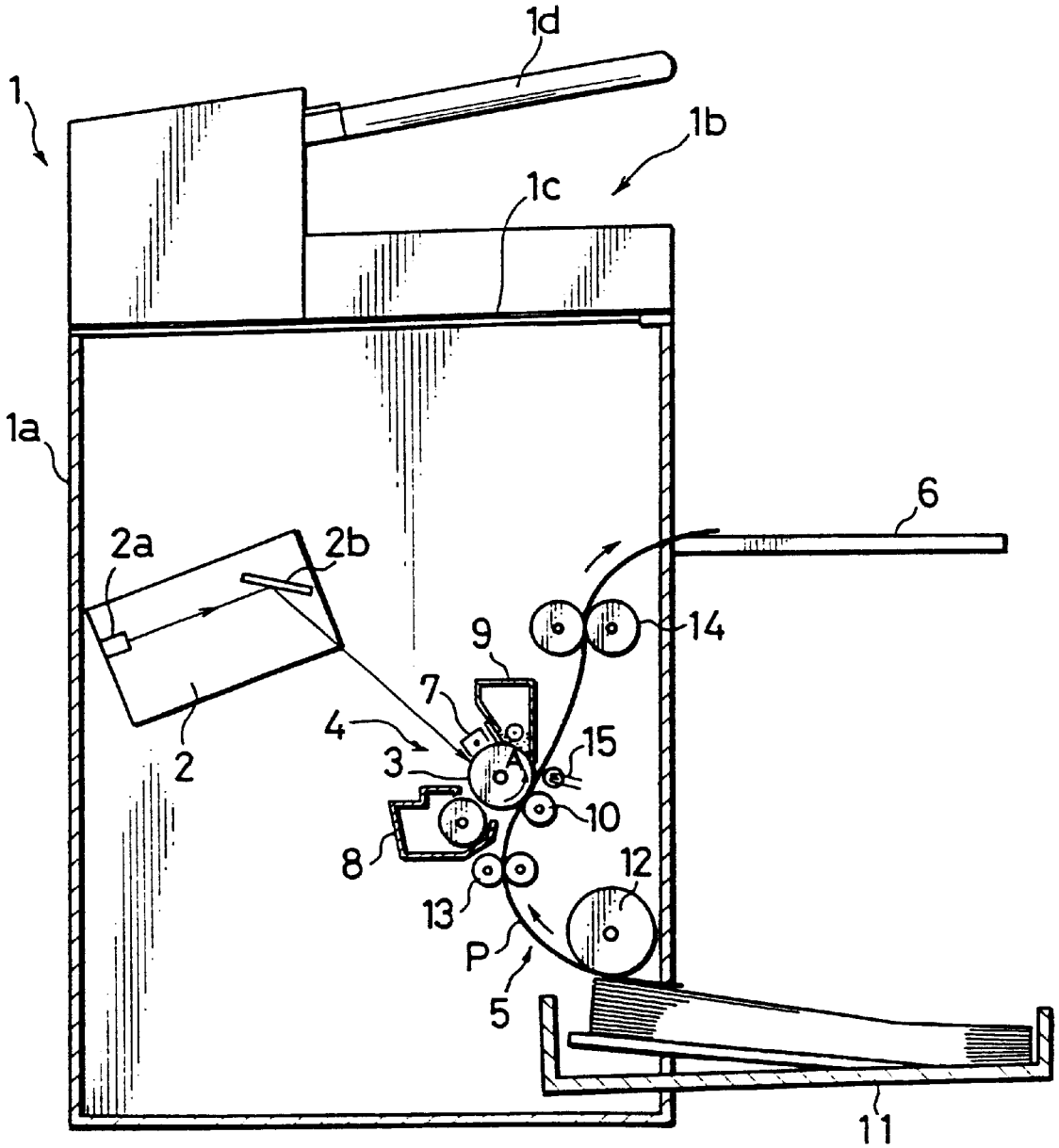
FIG. 1 is a vertical section schematically showing a construction of a copier incorporated with a photosensitive drum and an image processing unit according to this invention.

FIG. 1 is a vertical section showing a copier as an embodiment of an image forming apparatus incorporated with a photosensitive drum and an image processing unit of this invention. In FIG. 1, the copier 1 comprises a main body 1*a* and a document setting portion 1*b*. The main body 1*a* mainly comprises an unillustrated document reader, an optical unit 2, an imaging assembly (an image processing unit) 4 provided with a photosensitive drum 3, and a copy sheet transport mechanism 5.

The document setting portion 1*b* has a contact glass 1*c* on a top surface of the main body 1*a*. An original document set on the contact glass 1*c* is held by a document presser 1*d*. An image on the original document set on the contact glass 1*c* is read by an image scanner (not shown) of the image reader by reciprocating the image scanner line after line to read the whole image of the document. Thus, when image data is generated by scanning of the whole image, the image data is subject to a predetermined data process, converted into a digital signal, and stored in a memory (not shown).

The optical unit 2 disposed below the document setting portion 1*b* is operated such that a beam of laser is emitted by a light emitter 2*a* in accordance with the image data of the original document which is read out from the memory. The laser beam emitted by the light emitter 2*a* is projected onto the photosensitive drum 3 via a mirror 2*b*.

The imaging assembly (or image processing unit) 4 includes a main charger 7, a developing device 8, a cleaning device 9 in the periphery along the circumference of the photosensitive drum 3. It should be noted that these members of the image processing unit 4 which are arranged in the periphery of the photosensitive drum are also referred to as "peripheral devices" hereafter.

The photosensitive drum 3 rotates in the direction of arrow A by driving a drive motor (not shown) to form an electrostatic region on the surface thereof opposing to the main charger 7. An electrostatic latent image is formed on the static region by projection of the laser light from the optical unit 2. Then, the electrostatic latent image is developed into a toner image at a region on the drum surface opposing to the developing device 8.

A transfer roller 10 is provided in the vicinity of the circumference of the photosensitive drum 3. The toner image is transferred onto a copy sheet at a region on the drum surface opposing to the transfer roller 10. Then, toner residues on the surface of the photosensitive drum 3 are removed at a region opposing to the cleaning device 9.

The copy sheet transport mechanism 5 has a paper cassette 11 mounted at a lower portion of the main body 1*a* to accommodate copy sheets in a stacked state, a feed roller 12 for dispensing the copy sheets one by one from the paper cassette 11, a pair of rollers 13 for guiding a copy sheet P dispensed out of the paper cassette 11 toward the photosensitive drum 3, and a fixing unit 14. The fixing unit 14 includes a heater roller internally provided with a heater and a presser roller. With this arrangement, the transferred toner image on the copy sheet P is fixed thereon to feed out the copy sheet P toward a stacker tray 6 disposed above the paper cassette 11.

The document setting portion 1*b* may be constructed in the form of a so-called "automatic document feeder" such that a set of documents placed on the document feeder are fed one by one onto a certain exposure position on the contact glass 1*c* and then discharged out of the contact glass 1*c* onto the document feeder after an image reading. A blank lamp (light source for removing remaining charges on the drum surface after a charging operation) is indicated at the reference numeral 15.

Next, an arrangement of the photosensitive drum and the peripheral devices around the photosensitive drum which is the gist of this invention is described in detail with reference to FIGS. 2A to 5.

First, a construction of a photosensitive layer formed on the photosensitive drum 3 is described. As pigments (dyes) for generating electric charges, there are pigments of azo type, disazo type, anthanthrone type, phthalocyanine type, indigo type, threne type, toluidine type, pyrazoline type, perylene type, quinacridone type, etc. One or more kinds of these charge generating pigments are used in a mixed form to form an area capable of charging on a desired region on the surface of the photosensitive drum.

In particular, pigments of phthalocyanine type are desirable, such as x-type metal free phthalocyanine or oxotitanyl phthalocyanine.

As a resin which is used as a medium (bonding resin) in which carriers for transporting electric charges (charge carriers) and the charge generating pigments are solved and dispersed, various kinds of resins can be used, e.g., styrene copolymer, acrylic copolymer, styrene-acrylic copolymer, olefin copolymer such as ethylene-vinyl acetate copolymer, polypropylene, and ionomer, poly(vinyl chloride), vinyl chloride-vinyl acetate copolymer, polyester, alkyd resin, polyamide, polyurethane, epoxy resin, polycarbonate, polyallilate, polysulfone, diallyl phtalate resin, silicone resin, ketone resin, poly(vinyl butyral) resin, polyether resin, and photo-curing type resins such as phenol resin and epoxy acrylate.

One or more kinds of the above bonding resins can used in a mixed form. In particular, styrene copolymer, acrylic copolymer, styrene-acrylic copolymer, polyester, alkyd resin, polycarbonate, polyallylate are desirable. More preferably, polycarbonate, "Pan Light" produced by Teijin Kasei Kabushiki Kaisha, and "PCZ" produced by Mitsubishi Gas Kagaku Kabushiki Kaisha are used.

Any known charge carrier which itself has the ability of transporting electrons or positive charges can be used.

Electron attracting materials such as paradiphenoquinone derivatives, benzoquinone derivatives, naphthoquinone derivatives, tetracyano ethylene, tetracyano quinodimethane, chloranil, bromanil, 2,4,7-trinitro-9-fluorenone, 2,4,5,7-tetranitro-9-fluorenone, 2,4,7-trinitro-9-dicyanomethylene fluorenone, 2,4,5,7-tetranitroxanthone, 2,4,8-trinitrothioxanthone; and polymerized materials of these electron attracting materials are some of the examples of the charge carriers.

Among the above, paradiphenoquinone derivatives, in particular, asymmetric type paradiphenoquinone derivatives are preferably used, because they are excellent in solubility as well as transportability of electrons.

Examples of paradiphenoquinone derivatives are not limited to the following, but preferably 3,5-dimethyl-3',5'-di-t-butyldiphenoquinone, 3,5-dimethoxy-3',5'-di-t-butyldiphenoquinone, 3,3'-dimethyl-5,5'-di-t-butylphenoquinone, 3,5'-dimethyl-3',5-di-t-butyldiphenoquinone, 3,5,3',5'-tetramethyldiphenoquinone, 2,6,2',6'-tetra-t-butyldiphenoquinone, 3,5,3',5'-tetraphenyldiphenoquinone, 3,5,3',5'-tetrachlohexyldiphenoquinone are desirable to be used, because they are excellent in solubility due to a small interaction between molecules resulting from less symmetry of the molecules.

As the carriers for transporting positive charges (positive charge carriers), the following is known, and among these, the carriers excellent in solubility and transportability of positive charges are used: pyrene, N-ethylcarbazole, N-isopropyl carbazole, N-methyl-N-phenylhydrazino-3-methylidene-9-carbazole, N-N-diphenylhydrazino-3-methylidene-9-ethylcarbazole, N-N-diphenylhydrazino-3-methylidene-10-ethylphenothiazine; N-N-diphenylhydrazino-3-methylidene-10-ethylphenoxazine; hydrazones such as p-diethylaminobenzaldehyde-N,N-diphenylhydrazone, p-diethylaminobenzaldehyde-α-naphthyl-N-phenylhydrazone, p-pyrrolidinobenzaldeyde-N,N-diphenylhydrazone, 1,3,3-trimethylindolenine-ω-aldehyde-N,N-diphenylhydrazone, p-diethylbenzaldehyde-3-methylbenzthiazolinone-2-hydrazone; 2,5-bis(p-diethylaminophenyl)-1,3,4-oxadizole; pyrazolines such as 1-phenyl-3-(p-diethylaminostyryl)-5-(p-diethylaminophenyl)pyrazoline, 1-[quinonyl(2)]-3-(p-diethylaminostyryl)-5-(p-diethylaminophenyl)pyrazoline, 1-[pyrydine(2)]-3-(p-diethylaminostyryl)-5-(p-diethylaminophenyl) pyrazoline, 1-[6-methoxy-pyridyl(2)] 3-(p-diethylaminostyryl)-5-(p-diethylaminophenyl) pyrazoline, 1-[pyridyl(3)]-3-(p-diethylaminostyryl)-5-(p-diethylaminophenyl)pyrazoline, 1-[lepidyl(3)]-3-(p-diethylaminostyryl)-5-(p-diethylaminophenyl)pyrazoline, 1-[pyridine(2)]-3-(p-diethylaminostyryl)-4-methyl-5-(p-diethylaminophenyl)pyrazoline, 1-[pyridyl(2)]-3-(α-methyl-p-diethylaminostyryl)-3-(p-diethylaminophenyl) pyrazoline, 1-phenyl-3-(p-diethylaminostyryl)-4-methyl-5-(p-diethylaminophenyl)pyrazoline, and spiropyrazoline; oxazole type compounds such as 2-(p-diethylaminostyryl)-3-diethylaminobenzoxazole, 2-(p-diethylaminophenyl)-4-(p-dimethylaminophenyl)-5-(2-chlorophenyl)oxazole; thiazole type compounds such as 2-(p-diethylaminostyryl)-6-diethylaminobenzothiazole; trianole methane type compounds such as bis(4diethylamino-2-methylphenyl) phenylmethane; 1,1-bis(4-N,N-diethylamino-2-methylphenyl)heptane, polyarylalkanes such as 1,1,2,2-tetrakis(4-N,N-dimethylamino-2-methylphenyl)ethane; benzidine type compounds such as N'-diphenyl-N,N'-bis (methylphenyl)benzidine, N,N'-diphenyl-N,N'-bis (ethylphenyl)benzidine, N-N'-diphenyl-N,N'-bis (propylphenyl)benzidine, N,N'-diphenyl-N,N'-bis (butylphenyl) benzidine, N-N'bis(isopropylphenyl) benzidine, N,N'-diphenyl-N,N'bis(secondary butylphenyl) benzidine, N,N'-diphenyl-N,N'bis(tertiary butylphenyl) benzidine, N,N'-diphenyl-N,N'bis(2,4-dimethylphenyl) benzidine, N-N'-diphenyl-N,N'bis(chlorophenyl)benzidine; diaminonaphthalene derivatives, diaminophenanthrene derivatives, triphenylamine, poly-N-vinylcarbazole, polyvinyl pyrene, polyvinyl anthracene, polyvinyl acrydine, poly-9-vinylphenyl anthracene, pyrene-formaldehyde resin, ethylcarbazole formaldehyde resin.

As the positive charge carrier, it is preferable to use benzidine type derivatives, phenylenediamine type derivatives, diaminonaphthalene derivatives, and diaminophenanthrene derivatives among aromatic amines.

In addition to the above, carbazolehydrazone type derivatives among hydrazones are also desirable.

For the purpose of pursing high photosensitivity and performing reversal process efficiently, it is preferable to use electron carriers (or simply "ET") and positive charge carriers (or simply "HT") in a combined manner. Preferably, the weight ratio of ET and HT (ET:HT) is set to be in the range from 10:1 to 1:10, and particularly, in the range from 1:5 to 1:1.

As compositions for exhibiting photosensitivity of the photosensitive drum according to this invention, various well known compounding agents such as oxidation inhibitor, radical capturing agent, singlet quencher, ultraviolet (UV) ray absorber, softener, surface reformer, deforming agent, filler, thickener, dispersion stabilizer, wax, acceptor, donor can be added to such an extent as not to adversely affect electrophotographic characteristics of the copier.

Further, adding steric hindrance phenol type oxidation inhibitor of 0.1 to 6 weight % per solids content can remarkably improve durability of the photosensitive layer without adversely affecting the electrophotographic characteristics of the copier.

As a supporting member on which the photosensitive layer is formed, various conductive materials can be used. Metallic materials (simple substance) such as aluminum, iron, copper, tin, platinum, gold, silver, vanadium, molybdenum, chromium, cadmium, titanium, nickel, indium, stainless steel, and brass; plastic materials which have been subject to vapor deposition or have been laminated; and glass covered with aluminum iodide, oxidized tin or oxidized indium are some of the examples of the conductive materials.

In the case where a single layer dispersion type photosensitive drum is used in the present invention, a tube made of aluminum or a tube which is processed with alumite to form an aluminum layer of 1 to 50 μm can be used as a supporting drum (base member).

To form the single layer dispersion type photosensitive drum, the charge generating pigment is added in a solution containing the charge carriers and the bonding resin. Then, the solution added with the pigment is subject to dispersion according to a well-known process, e.g., with the use of a roller mill, a ball mill, an at-writer, a paint shaker or a dispersion machine using an ultrasonic wave to prepare a coating solution. Then, the prepared coating solution is applied on the conductive base member by a well-known coating means, and the solution coated on the conductive base member is dried to form a photosensitive layer on the base member. The thickness of the photosensitive layer to be formed on the base member is not limited to any range, but generally, it is preferable to set the thickness in the range from 10 to 40 μm, and in particular in the range from 20 to 35 μm.

In the case where a multi-layered type electrophotographic photosensitive drum is to be obtained, first, on a conductive base member, there is formed a layer for generating electric charges which contains the charge generating agent (pigment) by vapor disposition or a coating means. Next, on the thus formed charge generating layer, a coating solution containing the electron carrier or the positive charge carrier mixed with the bonding resin is coated, and is then dried to form a charge carrying layer.

When forming the above multi-layered photosensitive drum, the charge generating agent constituting the charge generating layer and the bonding resin can be mixed with various ratios. Preferably, 5 to 1000 weight parts of the charge generating agent, more preferably, 30 to 500 weight parts of the charge generating agent may be added in the bonding resin of 100 weight parts.

As for the charge carrying layer, the mixing ratio of the electron carrier or the positive charge carrier with the bonding resin can be set at various ratios as far as the transportability of electric charges is not obstructed and crystallization does not occur.

Preferably, the thickness of the photosensitive layer of the multi-layered photosensitive drum is set such that the thickness of the charge generating layer is set in the range of 0.01 to 5 $\mu$m, preferably in the range of 0.1 to 3 $\mu$m, and the thickness of the charge carrying layer is set in the range of 2 to 100 $\mu$m, preferably in the range of 2 to 50 $\mu$m.

Preferably, a barrier layer may be formed between the conductive base member and the photosensitive layer in the single layered photosensitive drum, and between the conductive base member and the charge generating layer, between the conductive base member and the charge carrying layer or between the charge generating layer and the charge carrying layer in the multi-layered photosensitive drum as far as the photosensitivity is not impaired.

Further, a protective layer may be formed on the surface of the photosensitive drum.

As a solvent used in preparing the coating solution, various types of organic solvents may be used: alcohols such as methanol, ethanol, isopropanol, butanol; aliphatic hydrocarbons such as n-hexane, -octane, -cyclohexane; aromatic hydrocarbons such as benzene, toluene, xylene; halogenated hydrocarbons such as dichloromethane, dichloroethane, carbon tetrachloride, chlorobenzene; ethers such as dimethyl ether, diethyl ether, tetrahydrofuran, ethyleneglycol methylether, diethyleneglycol dimethylether; ketones such as acetone, methylethyl ketone, cyclohexane; esters such as ethyl acetate and methyl acetate; dimethyl formamide; and dimethyl sulfoxide.

One or more kinds of these solvents can be used in a mixed form. The solid content of the coating solution is generally set in the range of 5 to 50%.

As a material for forming a flange member (drum flange) to be described later, a synthetic resin such as polytetra fluoroethylene, polyoxymethylene, polyacetal, nylons, and a metal such as aluminum, stainless steel, iron, nickel, chromium, and titanium can be used.

Figure 2A:
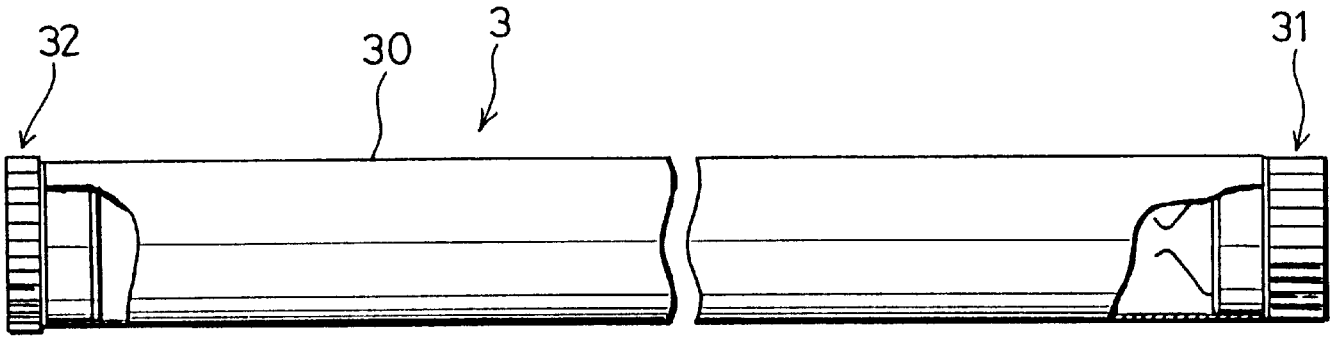
FIGS. 2A to 2C are explanatory diagrams of a construction of the photosensitive drum according to this invention.
Figure 2C:
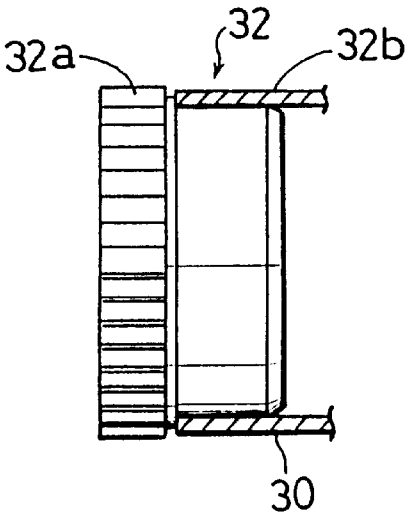
Figure 2B:
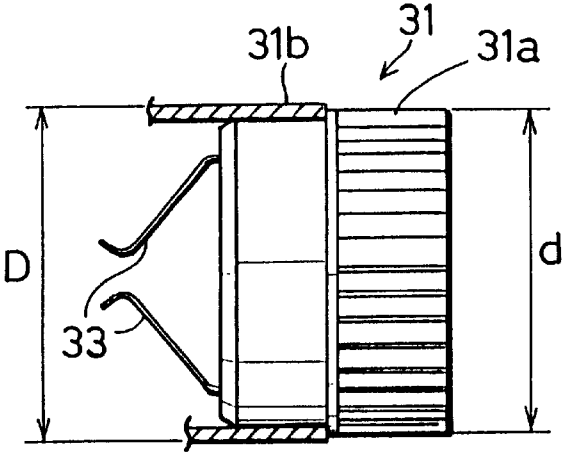

FIGS. 2A to 2C show a construction of the photosensitive drum 3. Specifically, FIG. 2A is a front view partially showing a cutaway portion of the photosensitive drum 3.

Referring to FIG. 2A, the photosensitive drum 3 includes a cylindrical main body 30 and flange members (drum flanges) 31 and 32 each formed with a gear portion. The drum flanges 31 and 32 are pressingly fitted in the main body 30 from opposite axial ends of the drum main body 30. It should be noted that the gear portion 31*a* (32*a*) is formed at an outermost circumference of the drum flange 31 (32) in this embodiment.

The gear portion 31*a* formed at the drum flange 31 is in mesh with a drive gear wheel (not shown) for rotating the photosensitive drum 3. As shown in FIG. 2B, the drum flange 31 is formed along a circumference of the photosensitive drum 3 at its axial end. The drum flange 31 includes the gear portion 31*a* whose outer diameter d is set not greater than an outer diameter D of the drum main body 30, and a fitting portion 31*b* which is integrally formed with the gear portion 31*a* and has a diameter substantially equal to a diameter of an inner wall of the cylindrical main body 30.

Referring to FIG. 2C, a gear portion 32*a* of the drum flange 32 transmits a rotating force of the photosensitive drum 3 to a screw shaft of the cleaning device 9 which is described later. The screw shaft mechanically removes toner residues on the surface of the photosensitive drum 3.

Similar to the drum flange 31, the drum flange 32 is formed with a fitting portion 32*b*. The drum flange 31 (32) is provided with a metallic pin (not shown) which enables contact with the inner circumferential wall of the drum main body 30 to charge the photosensitive drum 30 and to prevent idling of the drum flange 31 (32).

The drum flange 31 is internally provided with a grounding member 33 which is in contact with a conductive rod passing through an inner space (hollow space) of the photosensitive drum 3 for grounding. The drum flange 31 (32) is fitted in the photosensitive drum 3 by a so-called "tapered fitting" in which the fitting portion 31*b* (32*b*) formed with a tapered portion at a leading end thereof slides along the inner wall of the photosensitive drum 3 in pressing contact therewith by inserting the tapered portion into the axial end of the drum main body 30.

Figure 3:
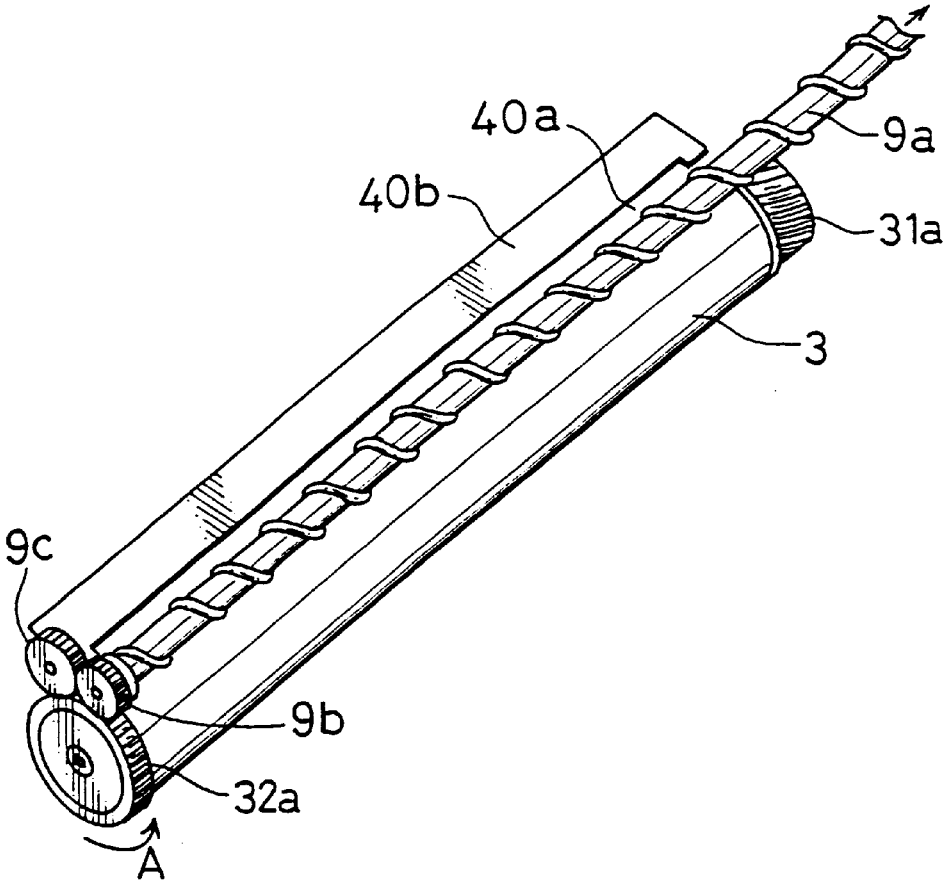
FIG. 3 is a perspective view showing a positional relationship between the photosensitive drum and a cleaning mechanism.
Figure 4:
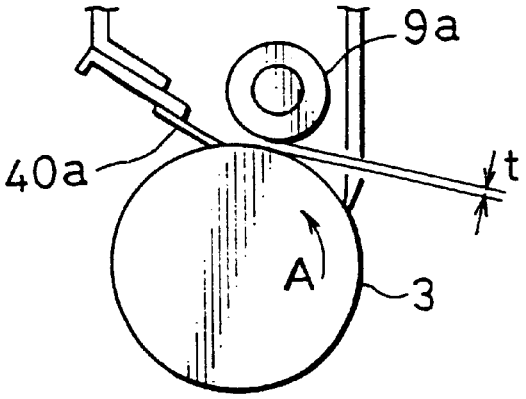
FIG. 4 is an explanatory diagram of an arrangement of the photosensitive drum and a screw shaft.

FIG. 3 shows an enlarged view showing a positional relationship between the photosensitive drum 3 and the cleaning device 9. As shown in FIG. 3, the screw shaft (transporter) 9*a* of the cleaning device 9 is disposed in parallel with the photosensitive drum 3 in the axial direction thereof. The screw shaft 9*a* is formed with a pinion gear 9*b* at one end thereof. The pinion gear 9*b* of the screw shaft 9*a* is in mesh with the gear portion 32*a* of the drum flange 32 of the photosensitive drum 3 via an idling gear wheel 9*c*.

The screw shaft 9*a* extends along the axial length of the photosensitive drum 3 in such a manner that the other end of the screw shaft 9*a* (a side opposite to the gear portion 9*b*) further extends from the axial end of the photosensitive drum 3 by a certain length to connect a toner collecting container 9*b*.

The photosensitive drum 3 is rotated via the gear portion 31*a* formed on the drum flange 31 which is in mesh with the drive gear wheel (not shown) driven by a drive source of the copier 1. A cleaning blade 40*a* is fixedly supported on a support plate 40*b* in pressing contact with the surface of the photosensitive drum 3. The support plate 40*b* and the cleaning blade 40*a* constitute a toner scraper mechanism.

With this arrangement, since the outer diameter of the gear portion 31*a* for rotating the photosensitive drum 3 is set smaller than the outer diameter D of the drum main body 30 (see FIG. 2B), the screw shaft 9*a* is arranged close to the photosensitive drum 3 in parallel with the photosensitive drum.

More specifically, in the prior art arrangement, the screw shaft has to be disposed away from the photosensitive drum to avoid contact with the gear portion of the drum flange because the gear portion of the drum flange has a diameter larger than the outer diameter of the drum main body. According to this invention, on the other hand, there is no need to avoid contact with such a large diametrical gear portion, as long as the screw shaft is disposed in such a way as to avoid contact with the outer circumference of the photosensitive drum 3.

Accordingly, a clearance t (see FIG. 4) which is defined by the drum surface and the outer circumference of the screw shaft 9*a* can be set at a small value. Thereby, toner residues on the drum surface do not stay long, and a load exerted to the rotating screw shaft 9*a* is lessened. As a result, toner discharge into the toner collecting container can be performed smoothly.

In this embodiment, the gear portion 31*a* of the drum flange 31 which is adapted for rotating the photosensitive drum 3 has the outer diameter d not greater than the outer diameter D of the drum main body 30. Alternatively, the gear portion 32*a* of the drum flange 32 to transmit the driving force of the copier 1 (photosensitive drum 3) to the cleaning device 9 may have the outer diameter not greater than the diameter D. As an altered form, each of the gear portions 31*a* and 32*a* may have the outer diameter not greater than the diameter D. In any case, as long as diameters of the gear portions of the photosensitive drum 3 are carefully engineered so as to enable that the outer circumference of the screw shaft 9*a* is positioned close to the outer surface of the photosensitive drum 3, the object of this invention is basically fulfilled.

Figure 5:
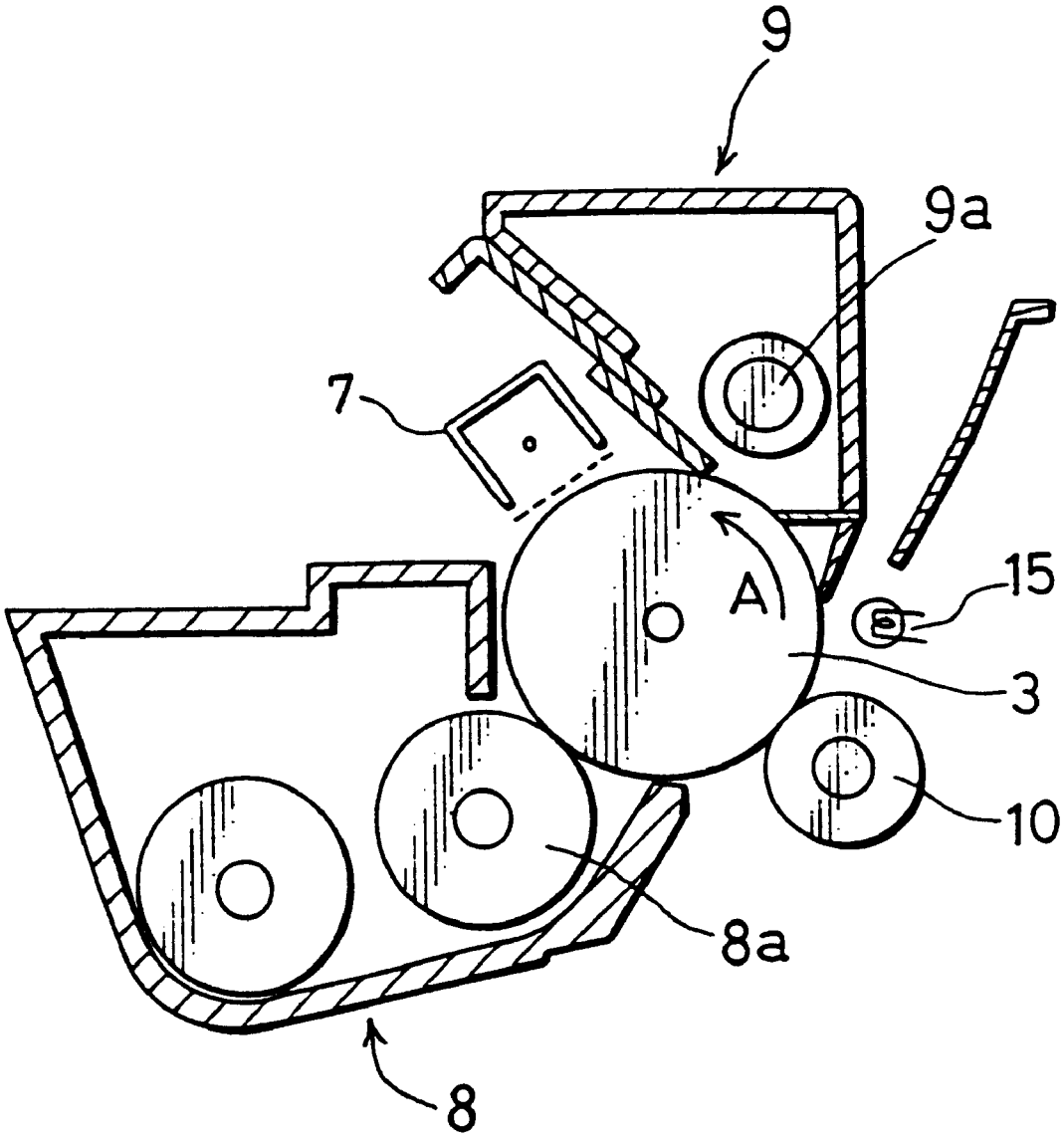
FIG. 5 is a partially enlarged view of the image processing unit including the photosensitive drum.
Figure 6:
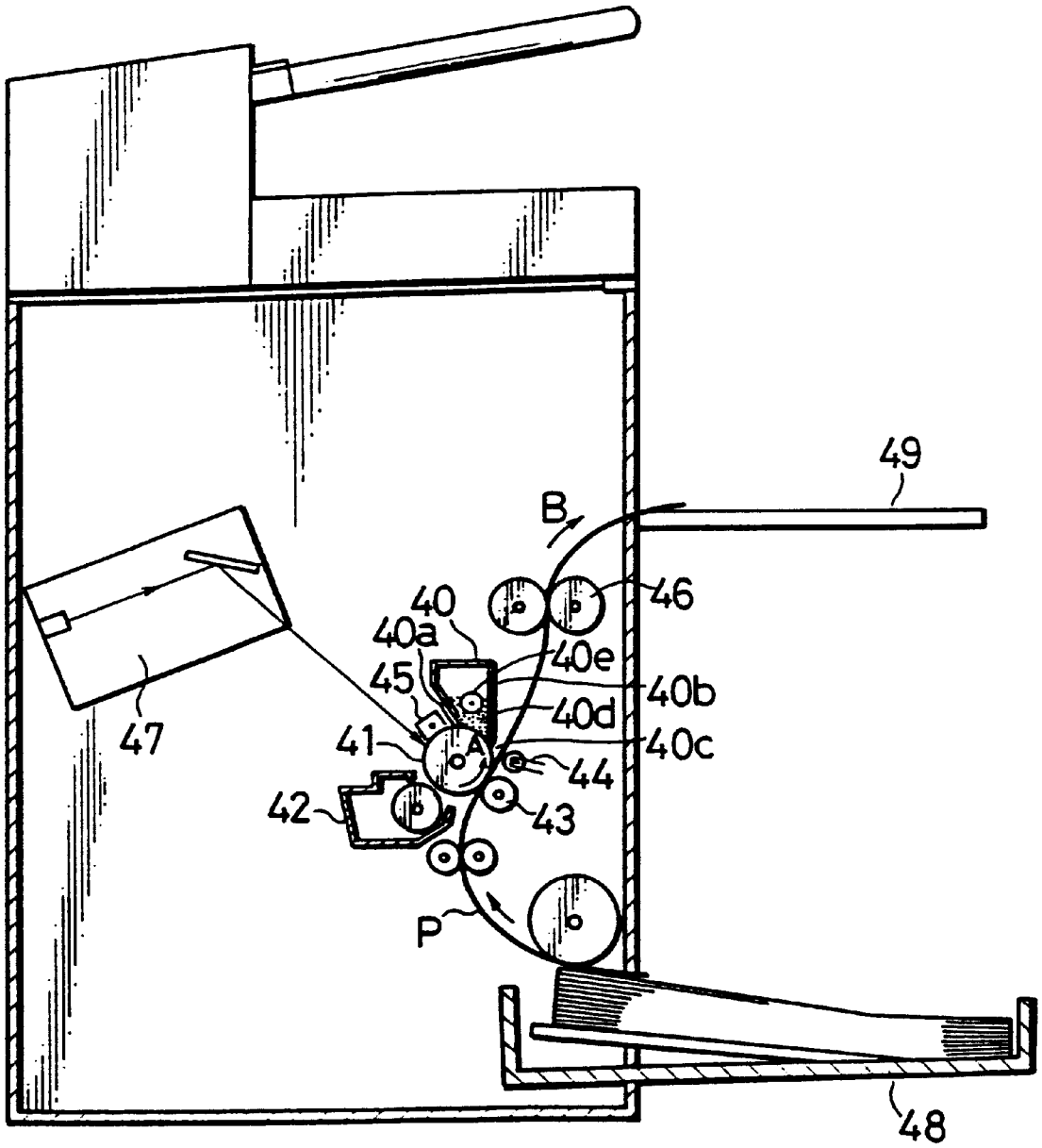
FIG. 6 PRIOR ART
FIG. 6 is a vertical section of an arrangement of a copier incorporated with an image processing unit of the prior art.

Referring to FIG. 5, the photosensitive drum 3 having the above arrangement is advantageous in assembling the peripheral devices (image processor means) such as the cleaning device 9, the main charger 7, the developing device 8 around the photosensitive drum 3 as an image processing unit for the following reasons.

The above arrangement in which the cleaning device 9 is arranged close to the photosensitive drum 3 is adaptable for any one of the peripheral devices other than the cleaning device 9. Accordingly, one or more of the peripheral devices can be arranged close to the photosensitive drum 3, leading to downsizing of the image processing unit (imaging assembly) 4. Further, the downsizing of the image processing unit leads to downsizing of the image forming apparatus.

In this embodiment, the transporter of this invention is a screw shaft. However, the transporter is not limited to the screw shaft, and may include any transport device which enables transportation of toner residues along the axial direction of the photosensitive drum, such as a device for rotating a helical coil.

The above arrangement of the photosensitive drum and the peripheral devices (replaceable units of the image processing unit) is applicable to any type of image forming apparatus such as a printer or a facsimile machine, as well as the copier.

As described above, according to the photosensitive drum of this invention, the cleaning device is disposed above the photosensitive drum close thereto. Accordingly, a blocking phenomenon of toner residues resulting in a poor image formation can be eliminated.

Further, when the above photosensitive drum is incorporated in an image forming apparatus, the image processor means such as a cleaning device can be arranged close to the photosensitive drum, thereby realizing downsizing of the image forming apparatus.

Moreover, according to the image processing unit of this invention, downsizing of the photosensitive drum itself and the image processing unit including the photosensitive drum and the peripheral devices as a whole is realized.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A photosensitive drum comprising:

a cylindrical main body;

a flange member mounted at opposite ends of the main body in an axial direction of the main body; and an external gear formed on at least one of the flange members, having an outer diameter equal to or smaller than an outer diameter of the photosensitive drum main body.

2. The photosensitive drum according to claim 1, wherein the photosensitive drum is provided in an image forming apparatus having an image processing means arranged close to the photosensitive drum.

3. The photosensitive drum according to claim 2, wherein a driving force is transmitted from a driving device of the image forming apparatus to the photosensitive drum via the one flange member formed with said external gear and is outputted to the image processing means via another gear formed on the other flange member.

4. The photosensitive drum according to claim 2, wherein the image processing means includes a cleaning device for mechanically removing toner residues on the photosensitive drum.

5. The photosensitive drum according to claim 4, wherein the cleaning device has a toner scraper mechanism for scraping the toner residues on a surface of the photosensitive drum, a toner collecting container for collecting the toner residues therein, and a transporter for transporting the toner residues scraped out by the toner scraper mechanism into the toner collecting container.

6. The photosensitive drum according to claim 5, wherein the transporter has a screw shaft extending along the axial direction of the photosensitive drum in such a manner that one end of the screw shaft extends beyond the length of the photosensitive drum, and the other end of the screw shaft has a pinion gear in mesh with a gear formed on the other flange member of the photosensitive drum, thereby transmitting a rotational force of the photosensitive drum to the screw shaft.

7. The photosensitive drum according to claim 4, wherein the cleaning device is arranged above the photosensitive drum.

8. The photosensitive drum according to claim 2 wherein, the image processing means includes a cleaning device for mechanically removing toner residues on the photosensitive drum, the cleaning device including a toner scraper mechanism extending along the axial direction of the photosensitive drum in such a manner that one end of the toner scraper mechanism extends beyond the length of the photosensitive drum, the other end of the toner scraper mechanism having another gear formed on the other flange member of the photosensitive drum, thereby transmitting rotational force of the photosensitive drum to the toner scraper mechanism.

9. The photosensitive drum according to claim 2 wherein said at least one member is disposed at one longitudinal end of the main body, the image processing means including a cleaning device for mechanically removing toner residue on the photosensitive drum, the cleaning device including a transporter shaft extending along the axial direction of the photosensitive drum in such a manner that one end of the transporter shaft extends beyond one longitudinal end of the photosensitive drum such that the transporter shaft extends further radially outwardly of the external gear than the photosensitive drum, thereby providing for positioning of the transporter shaft closer to the photosensitive drum then would otherwise be possible if said external gear had a diameter greater than the photosensitive drum, whereby such capability of positioning the transport shaft close to the photosensitive drum enables downsizing of the image processing unit.

10. An image processing unit adapted for being replaceable in an image forming apparatus, the image processing unit comprising a photosensitive drum and an image processing means, the photosensitive drum including a cylindrical main body, a flange member mounted at opposite ends of the main body in an axial direction of the main body, and an external gear formed on at least one of the flange members, having an outer diameter smaller than an outer diameter of the photosensitive drum main body, the image processing means including a cleaning device, a main charger, and a developing device arranged on a periphery of the photosensitive drum.

11. The image processing unit according to claim 10, wherein a driving force for rotating the photosensitive drum is transmitted via said external gear formed on said one flange member of the photosensitive drum and the driving force for rotating the photosensitive drum is transmitted to at least one component of the image processing means via another gear formed on the other flange member of the photosensitive drum.

* * * * *